US005369942A

United States Patent [19]

Olson

[11] Patent Number: 5,369,942

[45] Date of Patent: * Dec. 6, 1994

[54] CONVEYOR FLIGHT LONGITUDINAL PHASE ADJUSTMENT ASSEMBLY

[75] Inventor: Allen L. Olson, Crosby, Minn.

[73] Assignee: Riverwood International Corporation, Denver, Colo.

[ * ] Notice: The portion of the term of this patent subsequent to Sep. 7, 2010 has been disclaimed.

[21] Appl. No.: 50,595

[22] Filed: Apr. 22, 1993

Related U.S. Application Data

[63] Continuation of Ser. No. 856,450, Mar. 24, 1992, Pat. No. 5,241,806.

[51] Int. Cl.[5] ..... B65B 43/52

[52] U.S. Cl. ..... 53/566; 53/201; 53/252; 198/726

[58] Field of Search ..... 53/566, 564, 201, 249, 53/250, 251, 252, 237; 198/726, 731, 725

[56] References Cited

U.S. PATENT DOCUMENTS 3,325,977 6/1967 Kirsten ..... 53/201 X

*Primary Examiner*—James F. Coan

*Attorney, Agent, or Firm*—Joel Skinner

[57] ABSTRACT

A package transport mechanism having a plurality of phase adjustable lug-type flights. The mechanism is incorporated in a continuous motion packaging assembly for loading article groups into cartons or other carriers which comprises an article infeed mechanism supplying at least one stream of articles; an article group selection and transport mechanism intersecting the article infeed mechanism to form and transport a longitudinal stream of article groups of a predetermined pattern; a package supply mechanism synchronized and moving parallel with the article group selecting mechanism to provide packages with open ends facing the moving article groups; and an article group transfer mechanism which is constructed and arranged to move the article groups into the open ends of the packages.

15 Claims, 4 Drawing Sheets

CONVEYOR FLIGHT LONGITUDINAL PHASE ADJUSTMENT ASSEMBLY

This is a continuation of application Ser. No. 07/856,450, filed on Mar. 24, 1992 now U.S. Pat. No. 5,241,806.

BACKGROUND OF THE INVENTION

This invention relates to apparatus and methods used in the packaging industry. Particularly, this invention relates to conveyance mechanisms for use in continuous motion packaging assemblies which load groups of articles into cartons or carriers and which have flight adjustment means. The conveyor flight longitudinal phase adjustment apparatus of this invention enables the loading of articles, such as cans and bottles, in a wide range of article group sizes and patterns, into a variety of types, styles and sizes of paperboard or other carriers in a fast and reliable manner.

In the past, various machines and processes have been proposed and utilized to package selected article groups. Each prior art machine and process, however, accomplishes the packaging of the article groups in a distinct manner and utilizes specific structure. Moreover, prior art devices have limited adjustability and have been difficult to construct and maintain due to their respective designs. In particular, adjustment of the longitudinal distance or phase between conveyor flights or lugs has typically been accomplished by means of a phase variator. However, phase variators have significant limitations and shortcomings, including high expense and high maintenance requirements.

Despite the need for a device in the art which enables the reliable adjustment of the longitudinal separation distance between conveyor flights in packaging process, and which overcomes the limitations and problems of the prior art, none insofar as is known has been proposed or developed. Accordingly, it is an object of the present invention to provide a conveyance apparatus which continuously and reliably transports carriers or the like at high speed for packaging of product groups thereinto. Another object of this invention is to provide a continuous motion packaging conveyor which is adjustable for use with a variety of carton types and sizes.

SUMMARY OF THE INVENTION

The present invention provides a package transport mechanism having a plurality of lug-type flights, the longitudinal alignment or phase of which is adjustable. The mechanism is incorporated in a continuous motion packaging assembly for loading article groups into cartons or other carriers which comprises an article infeed mechanism supplying at least one stream of articles; an article group selection and transport mechanism intersecting the article infeed mechanism to form and transport a longitudinal stream of article groups of a predetermined pattern; a package supply mechanism synchronized and moving parallel with the article group selecting mechanism to provide packages with open ends facing the moving article groups; and an article group transfer mechanism which is constructed and arranged to move the article groups into the open ends of the packages.

The phase adjustable conveyance mechanism, comprises at least one first and at least one second endless chain, the chains being spaced apart and disposed parallel to each other; conveyance means coupled to the chains; an idler shaft and sprocket assembly coupled to the chains; and a drive shaft and sprocket assembly coupled to the chains such that the chains are driveable and revolve about the idler and drive shaft and sprocket assemblies. The drive shaft and sprocket assembly includes a rotatable first shaft having at least one first sprocket to which each first chain is coupled, and at least one second sprocket to which each second chain is coupled. The first sprocket is fixed to the first shaft and the second sprocket is rotatable about the first shaft. The drive assembly also includes a driven second shaft, means to releasably couple the first and second shafts, means to couple the second shaft to the second sprocket, and means to rotate the first shaft. These mechanism elements cooperate such that the phase of the first chain is adjustable with respect to the phase of the second chain.

These and other benefits of this invention will become clear from the following description by reference to the drawings.

DESCRIPTION OF THE PREFERRED EMBODIMENT

Figure 1:
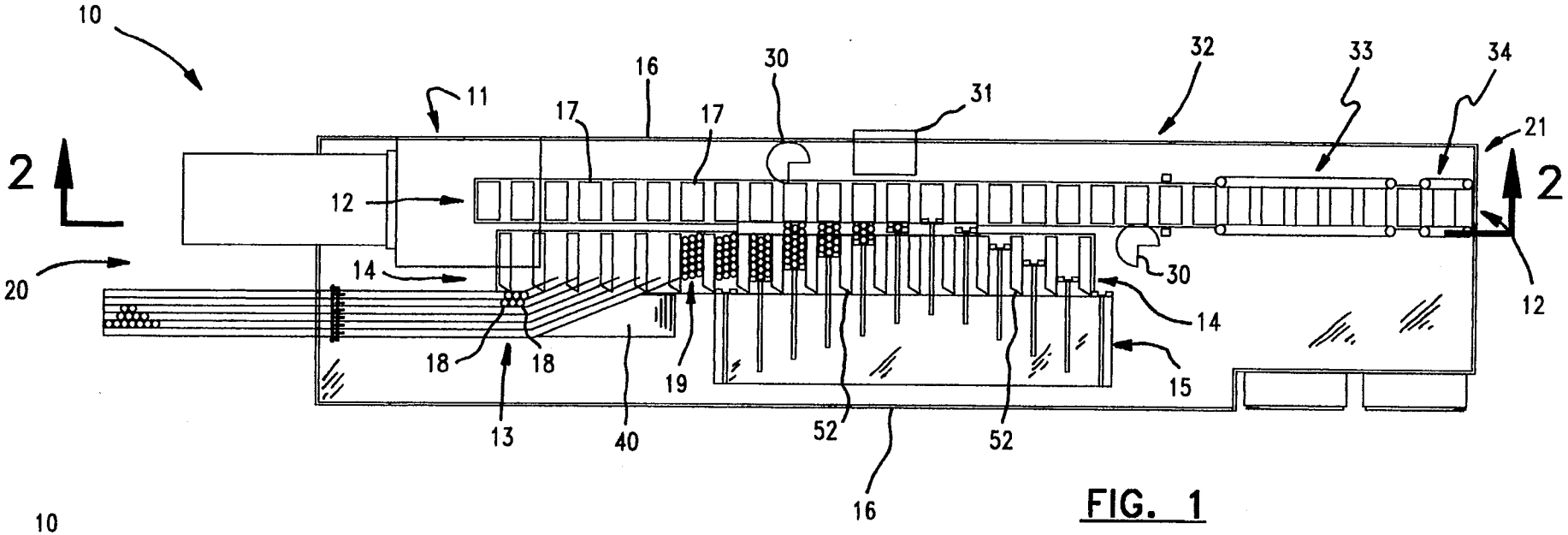
FIG. 1 is a top plan view of a cartoner assembly incorporating the carton transport mechanism of the present invention.

The apparatus of the present invention is for adjusting the packaging conveyance system to process a variety of carrier types and sizes and in a variety of orientations. As shown in the drawings, the carton transport apparatus of this invention is utilized in a continuous, high-speed packaging mechanism. The apparatus 12 of this invention has a simplified structure, and is highly adjustable to provide reliable, continuous and high speed transport of carriers of varying types and sizes for packaging purposes. For example, the apparatus 10 is useable in a packaging process for loading canned or bottled beverages into common 4–36 pack carriers and configurations utilizing the adjustment features described more fully below.

Figure 2:
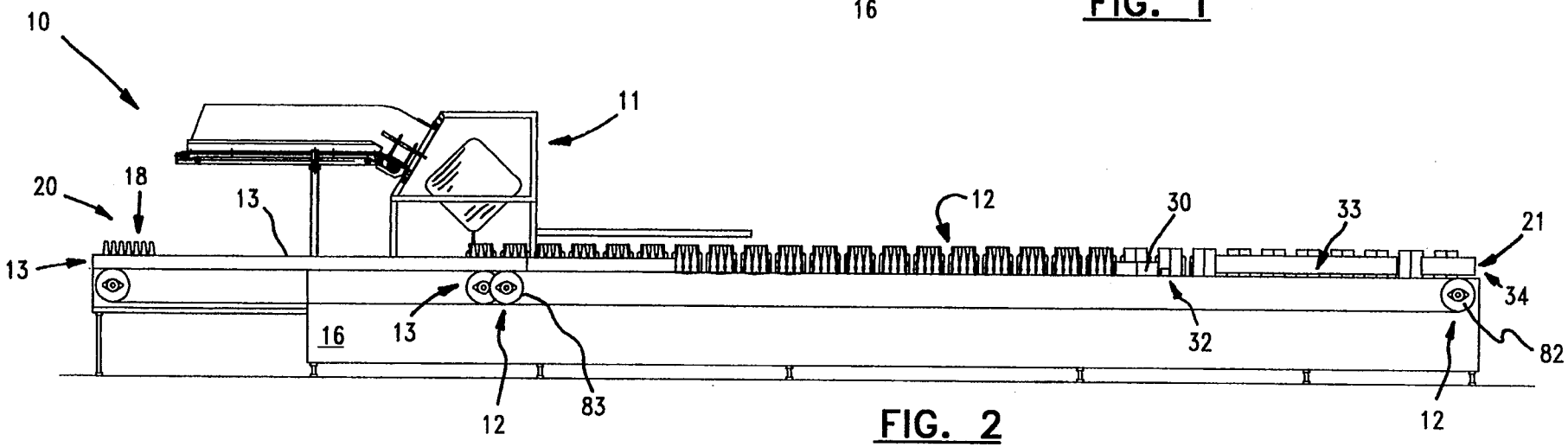
FIG. 2 is a side view of the cartoner assembly.

Referring to FIGS. 1 and 2, the continuous motion packaging assembly 10 generally comprises at least one carton supply mechanism 11, the carton transport mechanism 12, an article supply mechanism or conveyor 13, an article selection and transport mechanism or conveyor 14 and a product group transfer or cross loading mechanism 15. These mechanisms are shown to be supported by a unitary frame structure 16, although if aligned properly, separate support structures may be utilized consistent with the teachings of this invention.

The carton supply mechanism 11 is shown to be disposed at an input end 20 of and in line with the carton transport mechanism 12 to supply cartons 17 thereto. The cartons 17 are subsequently transported in a linear fashion to an output end 21 of the apparatus 10. The article supply mechanism 13 is also shown to be disposed at the input end 20 of the apparatus 10. A first portion of the article supply mechanism 13 is disposed anterior to and spacially parallel to the article transport mechanism 14, and a second portion merges, at a predetermined angle, with a predetermined first segment of the article transport mechanism 14 to a supply a stream of product or articles 18 thereto. These merging mechanisms 13 and 14 are further constructed and arranged to meter individual articles 18 in the mechanism 13, via a fixed flight bar arrangement into predetermined product or article groups on conveyor 14. The article transport mechanism 14 is disposed adjacent and parallel to the carton transport mechanism 12. The article groups 19 are transported downstream thereon in a spaced and metered fashion, each group 19 being aligned with a carton 17 traveling on the carton transport mechanism 12. The crossloading mechanism 15 is disposed adjacent to and parallel with the second portion of the article transport mechanism 14, extending and traveling linearly with respect to the upstream and downstream ends 20 and 21 of the apparatus 10. The crossloading mechanism 15 has means, extending transversely or perpendicularly with respect to the longitudinal axis of the transport mechanisms 14 and 12, to move product groups 19 on the article transport mechanism 14 into aligned cartons 17 traveling on the carton transport mechanism 12, thereby loading the cartons 17 with product groups 19.

Preferably, each of the aforementioned mechanisms 12, 13, 14 and 15 has a conveyor type structure with an endless chain or belt configured about rotatable drive and idler end means, as know in the art, and moving longitudinally with respect to the input (upstream) and output (downstream) ends 20 and 21 of the apparatus 10. The movement of each mechanism is further synchronized with one another, for example by a common drive and/or gearing means. Synchronized operation of these cooperating mechanisms 12–15, along with that of the carton supply mechanism 11, provides a continuous apparatus and process for selecting and metering a stream of individual articles 18 traveling in one linear stream into predetermined groups 19 traveling in a second parallel, linear stream, which are subsequently transversely loaded into cartons 17 traveling in a third parallel linear stream. As shown in the drawings, various ancillary processing mechanisms may be incorporated in the structure of the basic apparatus 10. For example, in the beverage cartoning apparatus 10, flap tuckers 30 are disposed adjacent each side of the carton transport mechanism 12, one anterior to the loading region to provide a closed carton backside against which the loaded containers may nest, and one posterior to the loading region to allow ingress to the carton 17 through its open, unglued end flaps. Gluing, compression and discharge mechanisms 32, 33 and 34 are disposed consecutively, further downstream and adjacent the carton transport mechanism 12 to complete the carton flap securement process.

Although the apparatus 10 shown in the drawings is utilized in a beverage bottle or can cartoning operation, modifications consistent with the teachings of this invention may be made to package various other liquid or gas containers or solid objects.

Still referring also to FIGS. 1 and 2, the carton supply and transport mechanism 11 is preferably a rotary type carton placer 49, such as that disclosed in U.S. Pat. No. 4,530,686 owned by Applicants' assignee. The carton erecting apparatus 49 is supported above the input end of the carton transport mechanism 11 by a vertically adjustable frame structure 50, and basically transfers flat carton blanks or sleeves 25 from a power magazine 51 to the conveyance surface of the mechanism 11, simultaneously opening the blank 25 so that it assumes a four-sided configuration with opposing open ends bounded by at least one flap 44 each. Importantly, the partially erected carton 25 is placed in a transverse or lateral orientation so that its ends are open to the sides of the carton transport mechanism 11 for loading purposes.

The carton transport mechanism 12 receives cartons 17 from the carton supply mechanism 11 as set forth above and transports them linearly downstream with respect to the overall apparatus 10. The downstream transport of cartons 17 is synchronized with the article transport mechanism 14 and with the crossloading mechanism 15 to affectuate carton 17 loading. Importantly, the carton transport conveyor 12 is adjustable to accommodate cartons 17 of varying types and sizes.

Figure 3:
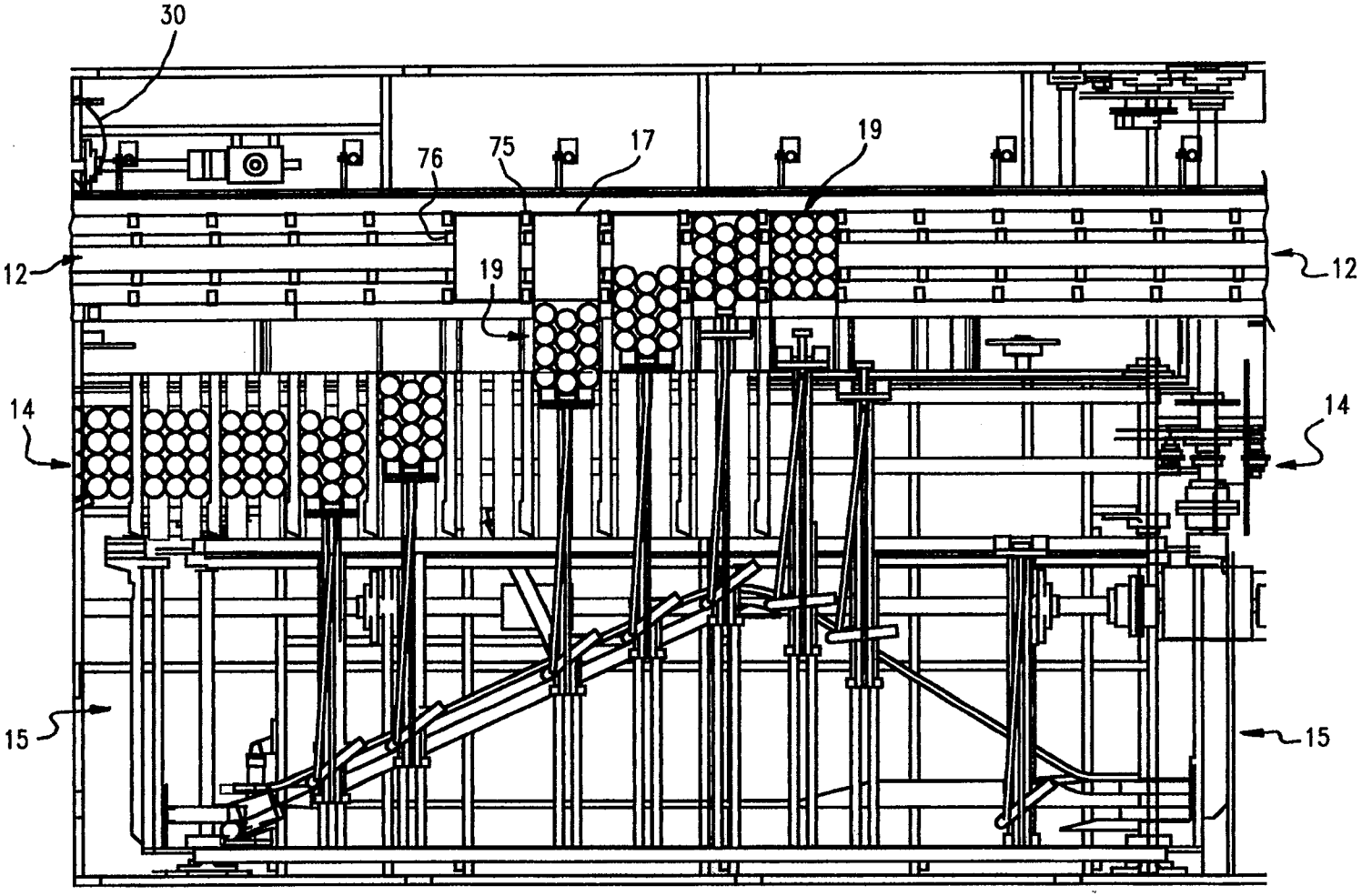
FIG. 3 is a top view of a portion of the carton transport mechanism at which cartons are side loaded.
Figure 4:
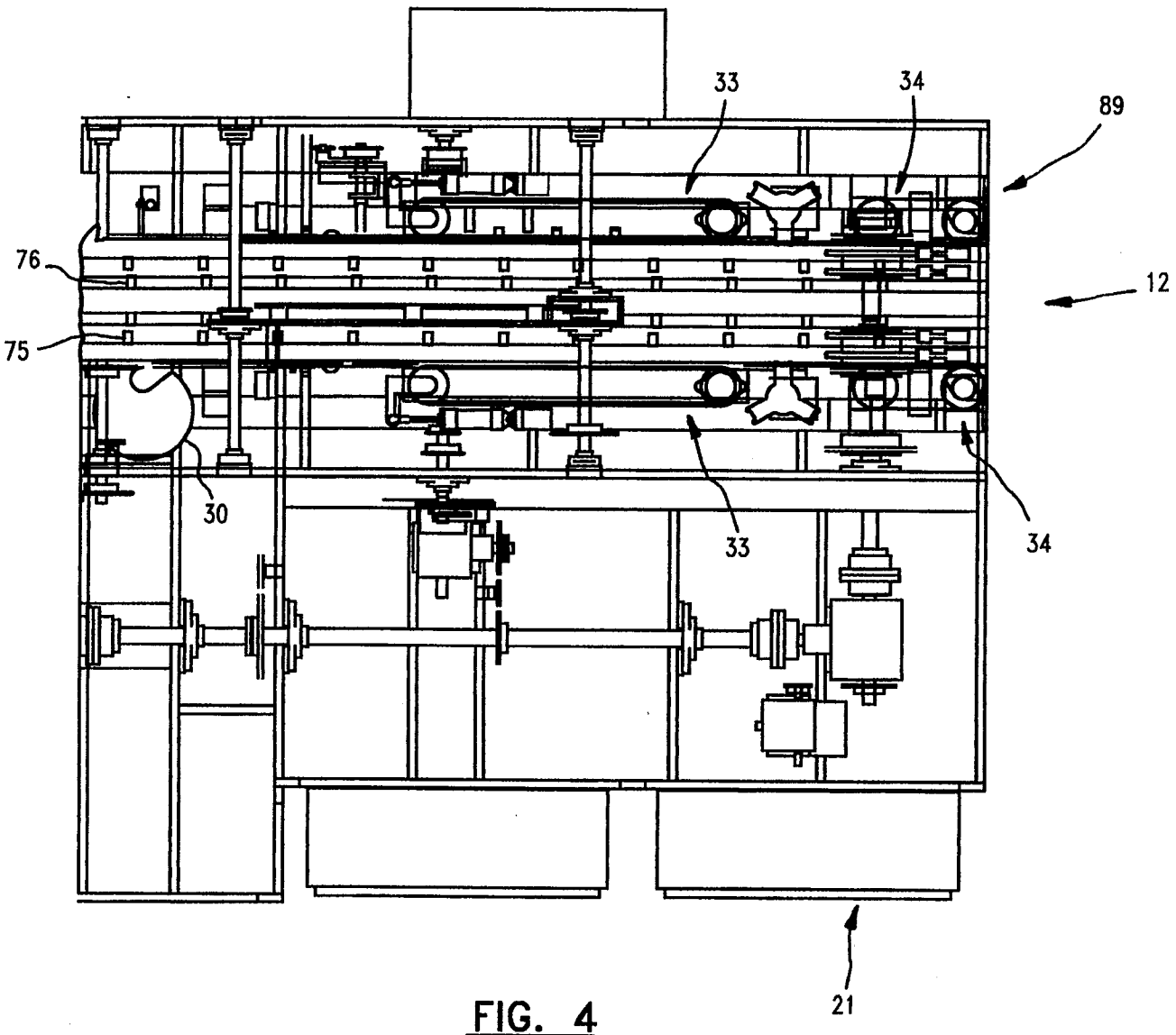
FIG. 4 is a top view of the cartoner assembly output end.
Figure 5:
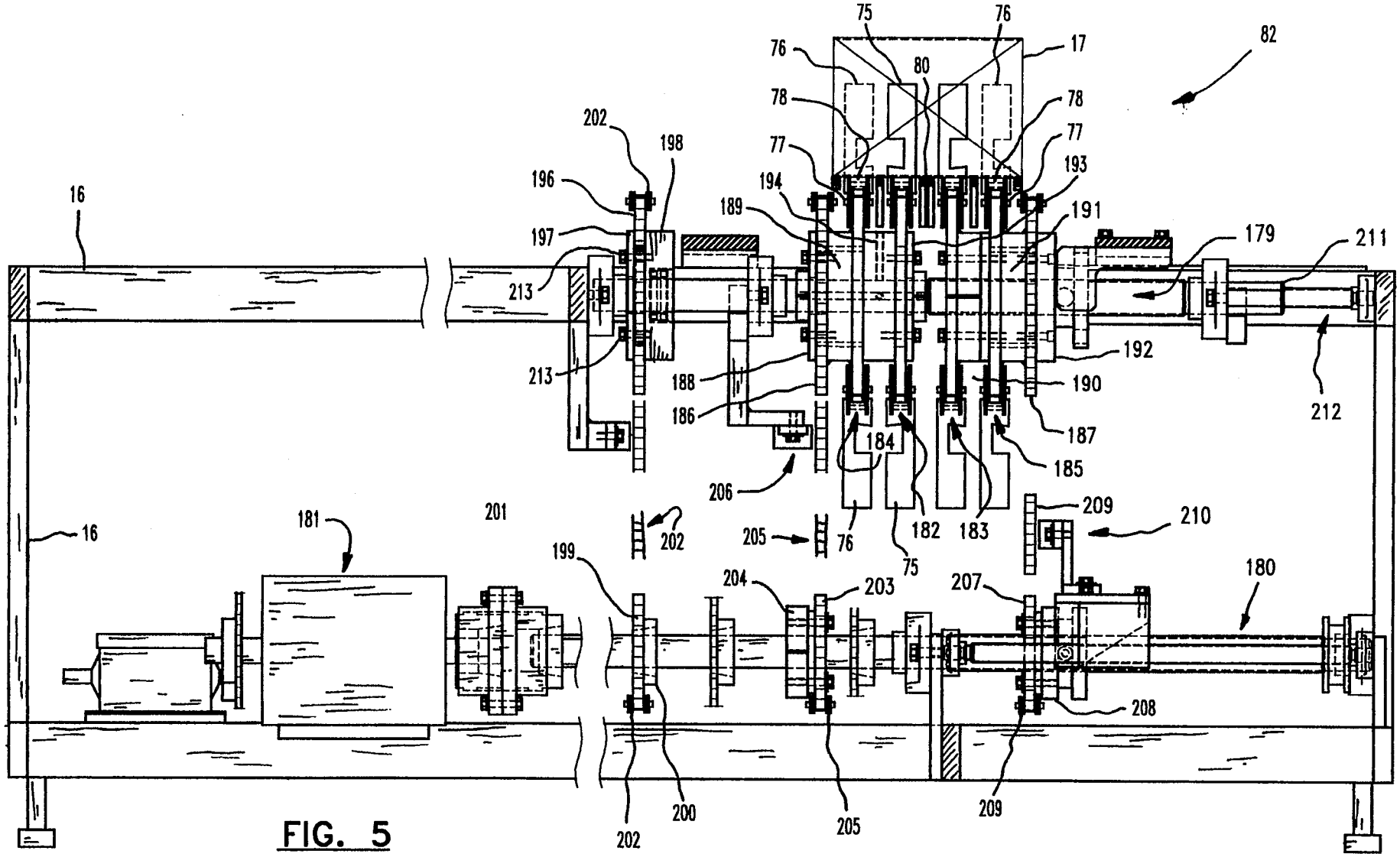
FIG. 5 is an end view of the cartoner assembly taken from the right side of FIG. 4 and showing the carton flight lug longitudinal phase adjustment features thereof.

Referring also to FIGS. 3–5, the carton transport mechanism 12 basically comprises a plurality of flight lugs 75 and 76 which are connected to endless, looped flight chains 77, the flight chains 77 being communicatively connected to and revolving about drive and idler ends 82 and 83. The number of lugs 75 and 76 per carton 17 may be varied. FIGS. 3–5 show an embodiment having four lugs 75 and 76 per carton 17 (two leading and two trailing). This arrangement provides transported processing of 12 pack cartons for beverage containers, for example. Alternative arrangements, including a three lug embodiment wherein two lugs trail and one leads, may also be constructed consistent with the teachings of this invention. Leading lugs 75 are disposed anterior to the carton 17 for control and stabilization purposes, while the trailing lugs 76 urge the cartons forward on the conveyor mechanism 12. The lugs are preferably constructed of nylon or a similar material. The lugs 75 and 76 are attached to the flight chains 77 via lug bases 78. The flight chains 77 are supported at both the top or forward run and the bottom or return run of the conveyor 12 by chain guides (not shown). The chain guides are connected to the main frame 16 via guide supports (not shown). An elongated, longitudinally extending return guide (not shown) is disposed along the bottom run of the conveyor 12 and mates with a notch in each lug 75 and 76 to stabilize their return during high speed operation. Additionally, longitudinally oriented slide rails 80 are disposed between each flight chain 77 and level with the horizontal plane of the article transport conveyor 14 slide plates 53. The slide rails 80 are preferably thin, elongated, metallic rails with a low-friction top surface which supports the bottom of each carton 17 on the conveyor 12.

The width-wise or transverse spacing between lugs 75 and 76 on the parallel, side-by-side chains 77 is variable via a transverse lug adjustment mechanism 212, as known in the art. The in-line or longitudinal spacing between lugs 75 and 76, also known as the lug phase, is adjustable via lug phase adjustment means disposed at the drive end 82 of the conveyor 12, as described more fully below. And, lug phase adjustment is accomplished without the use of prior art phase variators and their attendant shortcomings.

Referring to FIG. 14, the drive end 82 of the carton transport conveyor 12 primarily functions to longitudinally convey cartons 17 downstream in the apparatus and further provides adjustment of the longitudinal separation distance between or phase of the leading and trailing flight lugs 75 and 76. This phase adjustment is desirable to permit the apparatus 10 to be used with various carton configurations. The drive end 82 components are shown to primarily comprise a first or top drive shaft 179, a second or bottom drive shaft 180, a gear box 181, and a plurality of head sprockets 182–185 mounted on the first or head shaft 179. The flight lugs 75 and 76 mounted on flight chains 77 are longitudinally moved via rotation of their respective head sprockets 182–185. As was previously discussed, the flight lugs 75 and 76 are linked to flight chains 77 via the lug bases 78. The slide rails 80 are shown disposed between flight chains 77 for support of the carton 17 bottom.

The first or head shaft 179 is fixed to the mainframe 16 directly above and spacially parallel to the second drive shaft 180. The second drive shaft 180 is also connected to the frame 16, and further to the gearbox 181 which is communicatively connected to a main motor (not shown). Rotational force from the second drive shaft 180 is transferred to the first drive shaft 179 via drive chain 202, which is connected to drive sprockets 199 and 196. Drive sprocket 199 is coupled to second drive shaft 180 via taper lock bushing 200, and drive sprocket 196 is releasably coupled to first drive shaft 179 via clamp plate 197 and drive hub 198. Chain 202 tension is adjustable via take-up 201.

The leading lug head sprockets 182 and 183 are directly linked to the first drive shaft 179 and rotated thereby. The trailing lug sprockets 184 and 185 are not so linked, but are rotatable about the first drive shaft 179. The trailing lug tail sprockets 184 and 185 are not driven by the rotation of the first drive shaft 179. The first leading lug head sprocket 182 is coupled to the first drive shaft 179 via clamp plate 193 and fixed hub 194. The second leading lug head sprocket 183 is split and coupled to a drive hub 191. This structure permits removal of the leading lug sprocket 183 and its associated elements for conversion of the apparatus for processing smaller cartons such as 6-packs for example.

The first trailing lug head sprocket 184 is mounted for rotation about the first drive shaft 179 via clamp plate 188 and bushing 189. Drive sprocket 186 is provided to interface with drive chain 205 for transfer of rotational force from the second drive shaft 180 to head sprocket 184. Drive sprocket 186 is coupled to head sprocket 184 via bushing 189. Drive chain 205 is coupled to the second drive shaft 180 via drive sprocket 203, which in turn is attached to the shaft 180 via clamp hub 204. Tension in drive chain 205 is adjustable via take-up 206. The second trailing lug head sprocket 185 is mounted for rotation about the first drive shaft 179 via splined hub 190, drive hub 191 and splined adjustment hub 192. Freely rotatable drive sprocket 187 interfaces with drive chain 209 for transfer of rotational force from the second drive shaft 180 to head sprocket 185. Drive sprocket 187 is coupled to head sprocket 185 via bushing 191. Drive chain 209 is coupled to drive shaft 180 via drive sprocket 207, which in turn is attached to the shaft 180 via splined hub 208. Chain tension adjustment is provided by take-up 210.

In a normal conveyance mode, rotational force from the second drive shaft 180 is transferred to both the leading lug conveyance components, via direct connection to the first drive shaft 179, and to the trailing lug conveyance components freely rotating about the first drive shaft 179, by the sprocket and drive chain structures 186, 205, 187 and 209 described above. And, since these structures have corresponding dimensions, the rate of rotation of the trailing and leading conveyance components is synchronized such that a constant longitudinal phase is maintained. Lug phase is varied by first disengaging the first and second drive shafts 179 and 180, and subsequently rotating the first drive shaft 179 to advance the leading lugs 75. Since the trailing lugs 76 rotate freely with respect to the first drive shafts 179, they remain stationary during such rotation. Disengagement of the second drive shaft 180 is accomplished by loosening bolts 213 to free drive sprocket 196 from the first drive shaft 179. Rotation of the first drive shaft 179 is accomplished by means of a hex end 211 which is shown exposed for mating with a wrench or the like at an area of the apparatus 10 which is easily accessible to a technician. This mechanism allows for adjustment of carton spacing between, for example, 6 and 12 inch, on center arrangements whereby the apparatus is quickly and easily converted from 6 to 24 pack processing.

As many changes are possible to the embodiments of this invention utilizing the teachings thereof, the descriptions above, and the accompanying drawings should be interpreted in the illustrative and not the limited sense.

That which is claimed is:

1. A phase adjustable conveyance apparatus, comprising:

at least one first and at least one second endless chain, said chains being spaced apart and disposed parallel to each other;

conveyance means coupled to said chains;

an idler shaft and sprocket assembly coupled to said chains; and a drive shaft and sprocket assembly coupled to said chains such that said chains are driveable and revolve about said idler a drive shaft and sprocket assemblies, said drive shaft and sprocket assembly including a rotatable first shaft having at least one first sprocket to which each said at least one first chain is coupled, and at least one second sprocket to which each said at least one second chain is coupled, said first sprocket being fixed to said first shaft and said second sprocket being rotatable about said first shaft, a driven second shaft, means to releasably couple said first and second shafts, means to couple said second shaft to said second sprocket, and means to rotate said first shaft, whereby the phase of said at least one first chain is adjustable with respect to the phase of said at least one second chain.

2. The apparatus of claim 1, wherein said conveyance means are conveyer flights of a predetermined configuration for contact with at least one surface of a conveyed article.

3. The apparatus of claim 2, wherein the apparatus is incorporated in a continuous packaging operation, and wherein said conveyed article is a packaging container having a predetermined size and configuration.

4. The apparatus of claim 3, wherein said chains are looped about said idler and drive shaft and sprocket assemblies such that they form a top, linearly oriented downstream run for conveying articles and a bottom upstream run for returning said conveyer flights to said downstream run, said apparatus further having means, disposed at said downstream run, for supporting said articles, and wherein said flights of at least one said chain lead said conveyed article, and said flights of at least one said chain trail said conveyed article.

5. The apparatus of claim 4, wherein there are four chains, two providing leading conveyer flights and two providing trailing conveyer flights.

6. The apparatus of claim 5, wherein said leading conveyor flight chains are disposed interiorly with respect to said trailing conveyor flight chains.

7. The apparatus of claim 1, wherein said means to releasably couple said first and second shafts comprises a chain coupled to said second shaft via a fixed sprocket and to said first shaft via a sprocket connected to said first shaft by a releasable drive hub and clamp plate.

8. The apparatus of claim 1, wherein said means to couple said second shaft to said second sprocket comprises a chain coupled to said second shaft via a fixed sprocket and to said second sprocket via a sprocket rotatably disposed about said first shaft and connected to said second sprocket by a bushing and clamp means.

9. The apparatus of claim 1, wherein said means to rotate said first shaft comprises a connection end disposed on said first shaft.

10. The apparatus of claim 1, wherein said first sprocket is fixed to said first shaft via a hub and clamp means.

11. The apparatus of claim 1, wherein said second sprocket is rotatably coupled to said first shaft via a bushing and clamp means.

12. The apparatus of claim 1, wherein said means to releasably couple said first and second shafts comprises a chain coupled to said second shaft via a fixed sprocket and to said first shaft via a sprocket connected to said first shaft by a releasable drive hub and clamp plate, wherein said means to couple said second shaft to said second sprocket comprises a chain coupled to said second shaft via a fixed sprocket and to said second sprocket via a sprocket rotatably disposed about said first shaft and connected to said second sprocket by a bushing and clamp means, wherein said means to rotate said first shaft comprises a connection end disposed on said first shaft, wherein said first sprocket is fixed to said first shaft via a hub and clamp means, and wherein said second sprocket is rotatably coupled to said first shaft via a bushing and clamp means.

13. The apparatus of claim 12, wherein said conveyance means are conveyor flights and wherein there are four chains, two first chains providing leading conveyor flights, and two second chains providing trailing conveyor flights.

14. A phase adjustable conveyance apparatus for use in a packaging operation, comprising:

a) at least one first endless chain and at least one second endless chain spaced apart and disposed parallel with said at least one first chain;

b) a plurality of flight structures coupled to said chains at predetermined intervals, said flight structures on at least one said chain being disposed anterior to articles traveling on the apparatus, and said flight structures on at least one said chain being disposed posterior to the articles;

c) an idler shaft and sprocket assembly coupled to said chains;

d) a drive shaft and sprocket assembly coupled to said chains such that said chains are driveable and revolve about said idler and drive shaft and sprocket assemblies in a continuous loop with a linear, top downstream run and a bottom upstream run, said drive shaft and sprocket assembly including a rotatable first shaft having at least one first sprocket to which each said at least one first chain is coupled and at least one second sprocket to which each said at least one second chain is coupled, said first sprocket being fixed to said first shaft and said second sprocket being rotatable about said first shaft, a driven second shaft, means to releasably couple said first and second shafts, means to couple said second shaft to said second sprocket, and means to rotate said first shaft, whereby the phase of said flight structures on said at least one first chain are adjustable with respect to the phase of said flight structures on said at least one second chain; and e) means to drive said second shaft.

15. A phase adjustable conveyance apparatus for use in a packaging operation, comprising:

a) at least one first endless chain and at least one second endless chain spaced apart and disposed parallel with said at least one first chain;

b) a plurality of flight structures coupled to said chains at predetermined intervals, said flight structures on at least one said chain being disposed anterior to articles traveling on the apparatus, and said flight structures on at least one said chain being disposed posterior to the articles;

c) an idler shaft and sprocket assembly coupled to said chains;

d) a drive shaft and sprocket assembly coupled to said chains such that said chains are driveable and revolve about said idler and drive shaft and sprocket assemblies in a continuous loop with a linear, top downstream run and a bottom upstream run, said drive shaft and sprocket assembly including a rotatable first shaft having at least one first sprocket to which each said at least one first chain is coupled, and at least one second sprocket to which each said at least one second chain is coupled, said first sprocket being fixed to said first shaft and said second sprocket being rotatable about said first shaft, a driven second shaft, means to releasably couple said first and second shafts, means to couple said second shaft to said second sprocket, and means to rotate said first shaft, whereby the phase of said flight structures on said at least one first chain are adjustable with respect to the phase of said flight structures on said at least one second chain, wherein said means to releasably couple said first and second shafts comprises a chain coupled to said second shaft via a fixed sprocket and to said first shaft via a sprocket connected to said first shaft by a releasable drive hub and clamp plate, wherein said means to couple said second shaft to said second sprocket comprises a chain coupled to said second shaft via a fixed sprocket and to said second sprocket via a sprocket rotatably disposed about said first shaft and connected to said second sprocket by a bushing and clamp means, wherein said means to rotate said first shaft comprises a connection end disposed on said first shaft, wherein said first sprocket is fixed to said first shaft via a hub and clamp means, and wherein said second sprocket is rotatably coupled to said first shaft via a bushing and clamp means; and e) means to drive said second shaft.

* * * * *